US005236366A

United States Patent [19]

Deak et al.

[11] Patent Number: 5,236,366

[45] Date of Patent: Aug. 17, 1993

[54] HIGH DENSITY CIRCUIT CONNECTOR

[75] Inventors: Frederick R. Deak, Kernersville; Robert M. Renn, Pfafftown; Keith L. Volz, Jamestown, all of N.C.

[73] Assignee: AMP Incorporated, Harrisburg, Pa.

[21] Appl. No.: 889,034

[22] Filed: May 26, 1992

[51] Int. Cl.[5] ..... H01R 9/09

[52] U.S. Cl. ..... 439/67; 439/74; 439/260

[58] Field of Search ..... 439/59-62, 439/65, 66, 67, 74, 77, 260, 267, 630, 632, 635

[56] References Cited

U.S. PATENT DOCUMENTS 4,907,975 3/1990 Dranchak et al. ..... 439/493

OTHER PUBLICATIONS

IBM Technical Disclosure, Pluggable Flex Circuit, vol. 33, No. 6B, p. 110, Nov., 1990.

*Primary Examiner*—Neil Abrams

*Attorney, Agent, or Firm*—William B. Noll

[57] ABSTRACT

A high density electrical connector (10) includes a pair of plastic housings (12, 14) spring loaded by springs (50) to be driven apart and including guide surfaces (24, 34) and guide holes (30) that guide pins (52) on a mating component (60) to assure a proper alignment between circuit traces of component and connector and camming surfaces (24, 68) operable upon engagement to drive the housings relatively together to compress a flexible film elastomeric circuit (80) having traces (82) engaging with circuits (76) on a board (74) of a component. The film circuit includes a further elastomeric circuit held normally compressed by the housings under force of the mother board fastening means to interconnect to a further circuit (90) on the mother board (88). A use of the connector (10) includes electrically and mechanically interconnecting a component such as a hard drive disk to a component such as a computer.

9 Claims, 5 Drawing Sheets

HIGH DENSITY CIRCUIT CONNECTOR

This invention relates to a high density electrical circuit connector for interconnecting closely spaced circuit traces between components such as a computer and a disk drive.

BACKGROUND OF THE INVENTION

An increased packaging density of electronic components utilized in communication, computer, and business machine applications has created challenging problems with respect to interconnections, due not only to the physical difficulty of manufacturing small conductive and plastic parts, but also with respect to the forces of closure required by traditional pin and socket type connectors. Thus, in prior constructions wherein 10, 20, or as many as 100 interconnections were of necessity to be made to provide a connect, disconnect function between components, center-to-center spacings were frequently as much as 0.150 inches or larger with spacings of 0.100 inches and somewhat less quite common. These spacings allowed for production of connectors utilizing metal stampings for contacts and plastic moldings for housings readily achievable by state of the art manufacturing processes. Even there, high forces associated with high pin count frequently required jack screws or other hardware to force connector halves together and apart. Higher and higher line counts, extending into the hundreds for connect and disconnect requirements, have driven manufacturing of metal parts from traditional stamping and forming to etching and the use of photolithography to achieve spacings that have dropped from 0.050 inches to 0.025 inches and now are heading toward 0.010 inches or even less.

U.S. Pat. No. 3,985,413 granted Oct. 12, 1976 and U.S. Pat. No. 4,057,311 granted Nov. 8, 1977 detail a type of connector that utilizes contact pads or traces formed on the substrates of flexible film and compressed by an elastomeric body to effect an interconnection. Derivative concepts from these disclosed in the patents have not only allowed connectors to be designed in the smaller spacings mentioned above, but have proven to provide low resistance, stable electric interface interconnections that require less force of engagement.

Certain types of component interconnection, such as components that must be changed frequently by an end user, makes it desirable for interconnection and disconnection to be trouble-free and not require the use of hardware or relatively complicated manipulation of components together and apart. Interconnecting certain types of memory components, such as hard disk drives, to computers is an example of this requirement.

Accordingly, it is an object of the present invention to provide a high density connector for use in interconnecting and disconnecting components having large numbers of closely spaced circuit paths. It is a further object to provide a connector for components that is easy to use in effecting a connection or disconnection between the components. It is still a further object to provide a high density connector for connecting numerous circuit paths together with a reduced force requirement with the interconnection achieved through the plugging of one component into the other component.

SUMMARY OF THE INVENTION

The present invention achieves the foregoing objectives in a connector having a pair of plastic housings that have surfaces internested to define relative movement of the housings in a single direction together and apart. These surfaces include apertures and posts that fit together with spring elements positioned to drive the housings relatively apart and with means in the form of lock washers mounted on such posts to limit movement apart. Contained within the housings is a flexible film having circuit traces thereon, on close centers, matching the centers of traces on circuits such as circuit boards of components to be interconnected. The flexible film circuits of the connector are aligned within the housings to mate with the circuits on printed circuit boards of the components and include an elastomeric core for each circuit that operates when compressed to drive the circuit traces of a flexible film against the circuit traces of the boards or the components to effect an electrical interconnection therewith that is of low force, low resistance, and stable in electrical characteristics. The flexible circuit is contained within the plastic housings in alignment with respect to the circuits of one circuit board such as that of a computer, with the housings being mounted on such board by fasteners extending from one of the housings. That same housing includes apertures extending transversely through the connector housing relative to the mounting fasteners, positioned on the ends thereof, to receive guide pins mounted on the other component that serve to guide the other component into an aligned and proper engagement relative to the first circuit board. The other component, which may be a disk drive or the like, includes a circuit board extending outwardly between the guide pins containing circuit traces thereon that are aligned with the circuit traces of the flexible film, an upper portion thereof. Further included on the other component is a protective projection that extends out over the circuit board and includes, along an inner surface, a camming surface positioned to engage a complementary camming surface on the other housing, its upper side. The guide pins and projection of the other component extend over onto each side of the circuit board providing protection there too. In practice, by plugging the other component into the connector, the guide pins align the components together so that the circuit board of the other component enters between the two plastic housings into a position proximate the flexible film circuit traces in the upper part of the connector with the camming surfaces of the projection and the other housing engaging to drive the upper housing downwardly in turn driving the flexible circuit into engagement with the circuit of the other component, compressing the elastomeric body and effecting an interconnection of the various circuit traces. In the embodiment shown, the lower housing is made to compress the elastomeric body of the lower portion of the flexible film against the circuit traces of the board of the first component, the board of the computer, so that there is a normal interconnection between the lower portion of the film circuit and the upper portion as compressed during engagement. The foregoing occurs quite easily and straightforwardly when the other component is plugged into the connector mounted on the first component, with no additional hardware or manipulation of jackscrews or the like to the end that circuits on very close centers, large numbers of circuits, are readily interconnected upon the simple plugging in of a component. A disconnect occurs in the same fashion with the removal of the cam surface of the projection, the springs in the connector drive the housings relatively apart preparatory for subsequent use. The connector of the invention is essentially a one-piece assembly in terms of handling and use, simply snapped into place in a circuit board of a component such as a computer to be used without further requirements in connection with electrically and mechanically supporting a component plugged into such computer.

IN THE DRAWINGS

FIG. 3 is a front, elevational, and sectioned view of the connector shown in FIG. 2 taken from lines 3—3.

DETAILED DESCRIPTION OF THE INVENTION

Figure 1:
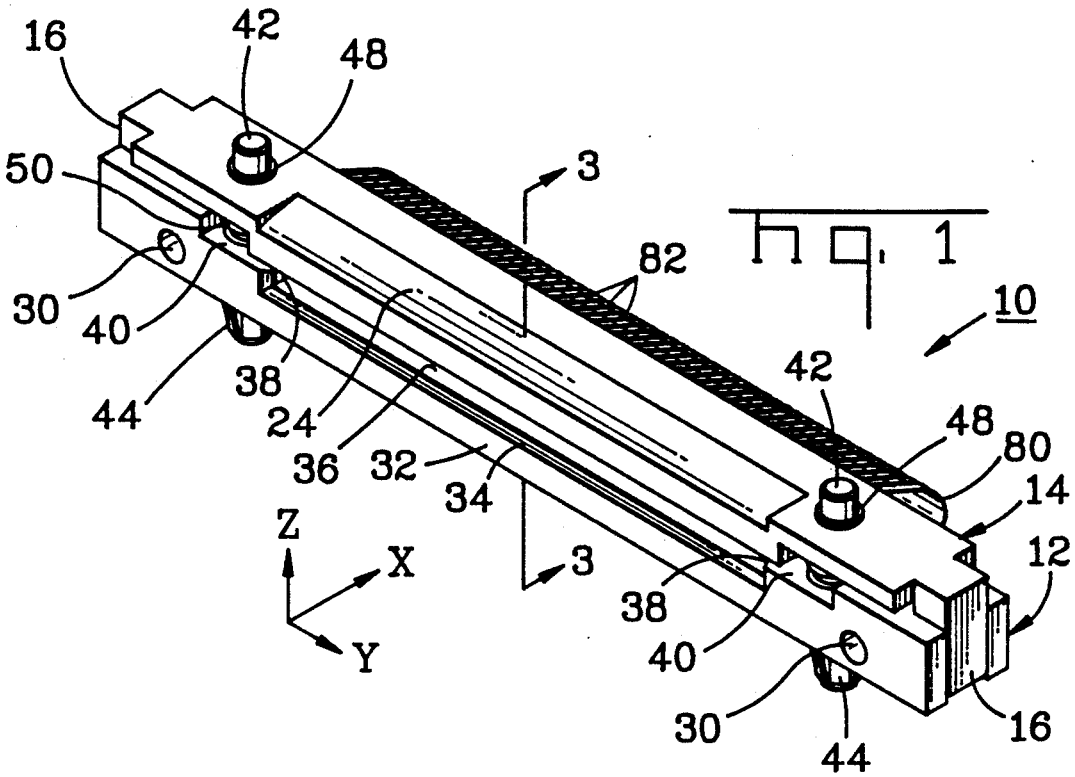
FIG. 1 is a perspective of the connector of the invention apart from use on components and in an open condition.
Figure 5:
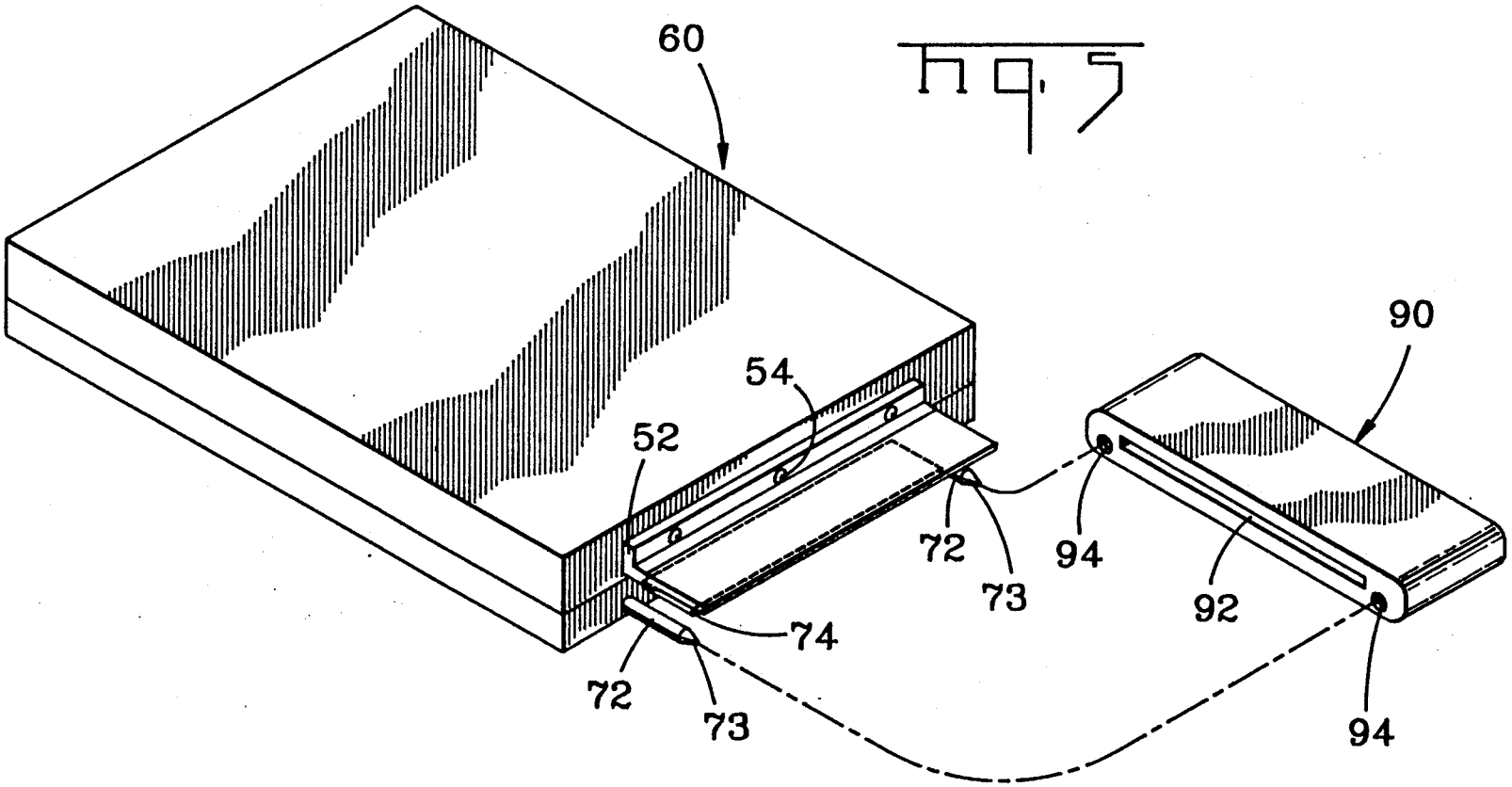
FIG. 5 is a perspective view of one component of the invention depicting a protective cap removed therefrom.
Figure 6:
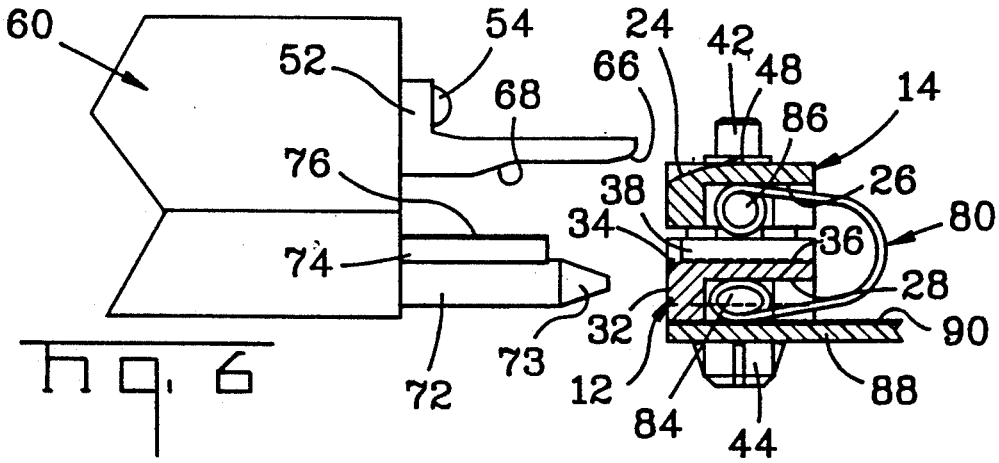
FIG. 6 is a side, elevational, and partially sectioned view showing the connector of the invention in an open condition prior to insertion of a component therewithin.
Figure 7:
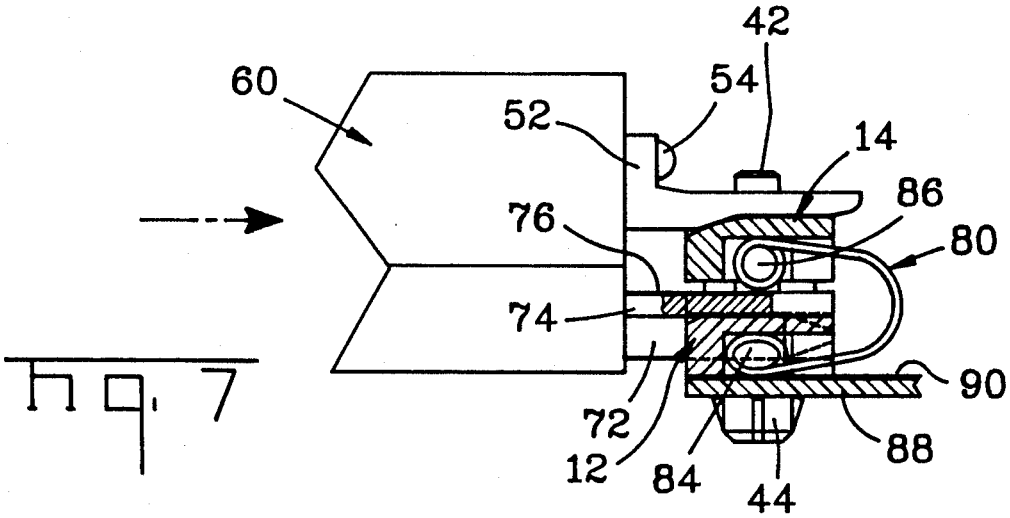

FIG. 1 shows the connector 10 of the invention to include a lower plastic housing 12, an upper plastic housing 14, a flexible film circuit 80, the three principal constituents of the connector. As shown in FIG. 6, the connector is mounted on a circuit such as printed circuit board 88 having conductive traces 90 on an upper surface thereof, the circuit board 88 being considered as the circuit board of a component such as a computer. The circuit traces 90 may be considered to lead to and from other components such as integrated circuits mounted on board 88 and interconnected to traces 90. Also shown in FIG. 6 and more completely in FIG. 5 is a further component 60 that is to be interconnected to the component associated with board 88. As can be seen in FIG. 6, component 60 includes a printed circuit board 74 having conductive traces 76 on the upper surface thereof. Circuits 76 extend within the package of component 60 to interconnect further components therewithin that serve memory and/or logic functions which are necessary for use with components associated with board 88. As can be appreciated, circuit traces 76 and 90 are typically etched or applied by additive processes to the board surfaces through the use of photolithography to allow extremely close center-to-center spacings of such circuits. Additionally, circuits may be contained within laminations of the boards to increase the density of circuit packaging.

Referring now to FIGS. 1 and 3, the plastic housing 12, the lower housing of connector 10, may be seen to include at its ends interior surfaces that receive projections 16 from upper housing 14 internested within the ends of housing 12. This internesting is controlled dimensionally to provide an easy sliding movement of housing 14 relative to housing 12. As can be discerned in FIG. 4, the upper housing 14 includes apertures 18 in the upper surface thereof and interiorly end surfaces 20 that engage end surfaces 22 of the lower housing 12. The engagement of these surfaces allows a movement of the housings, relatively together and apart, along the Z axis depicted in FIG. 1, while precluding movement of the housings along X and Y directions. As can be seen in FIG. 1 and in FIG. 6, the upper housing 14 includes, extending along the length thereof, a rounded surface 24 that provides part of camming surfaces that drive the upper housing downwardly upon insertion of a component. There is an interior surface 26 shown in FIG. 6 that serves to hold the film circuit within the connector. Also shown in FIG. 6, with respect to lower housing 12, is an interior surface 28 that serves a function similar to that of surface 26 but with respect to the lower portion of film circuit 80. As can be seen in FIG. 1, and in FIG. 3, the lower housing 12 includes, toward the ends, apertures 30 that face in an X direction and serve as alignment apertures. Extending along the length of housing 12 is a face 32 carrying at the edge thereof a rounded surface 34 that eases insertion of components.

Figure 2:
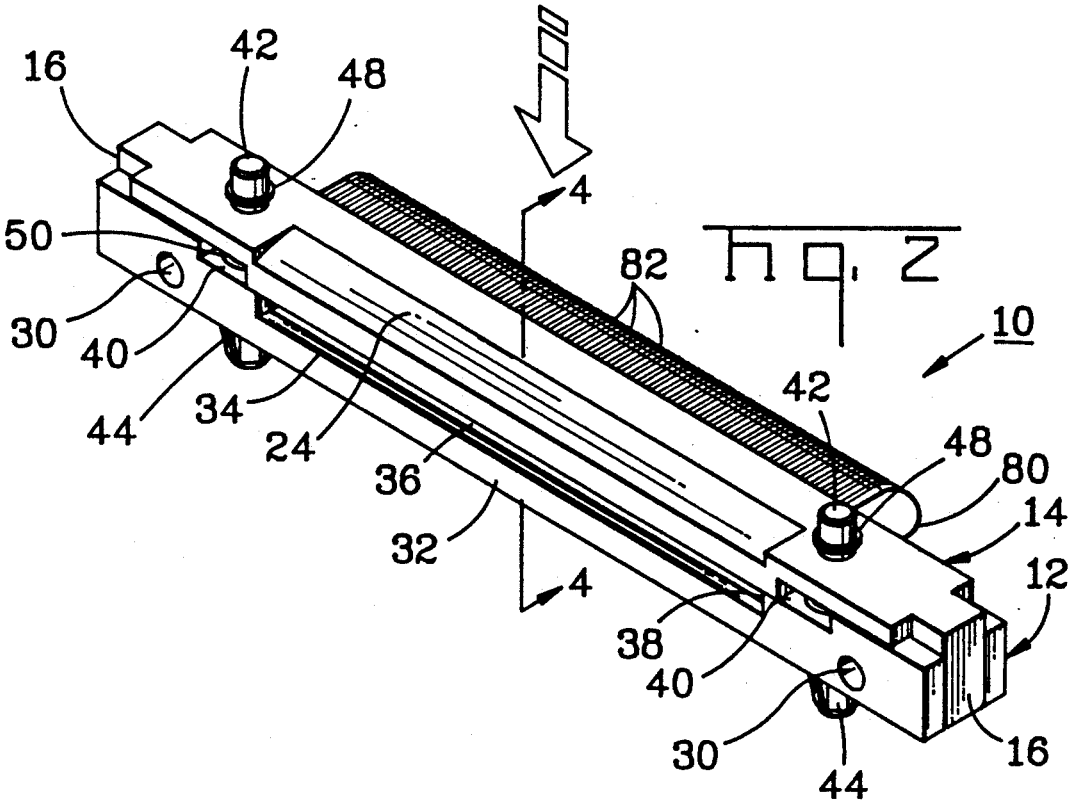
FIG. 2 is a perspective of the connector shown in FIG. 1, in a closed condition.
Figure 4:
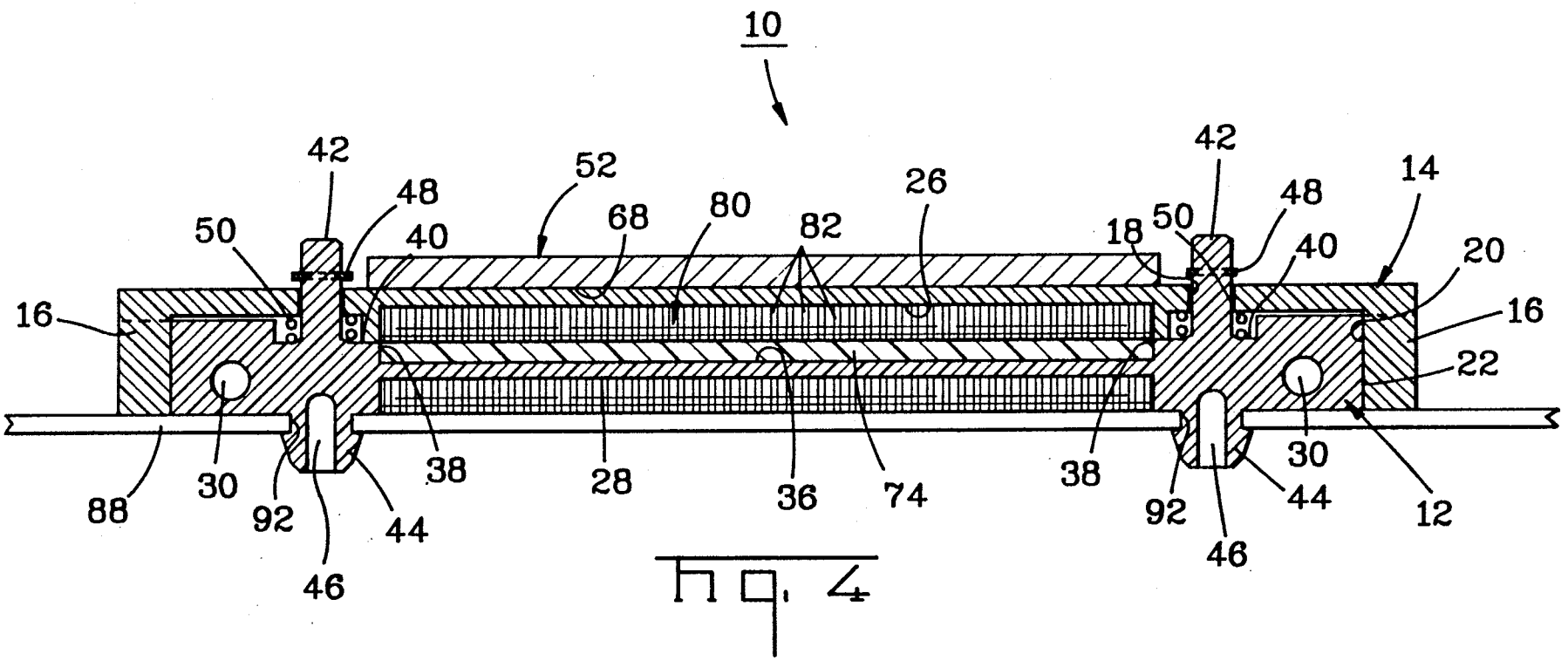
FIG. 4 is a front, elevational, and sectioned view taken through lines 4—4 of the connector in the closed condition with boards in place and inserted, taken through lines 4—4 of the connector in the position shown in FIG. 8.

The normally open condition of connector 10, shown in FIG. 1, defines a slot 36 extending between the upper and lower housing, such slots being apparent also in FIG. 2 and in FIG. 6. At the ends of slot 36 are vertical walls 38 that receive the sides of a circuit board of a component inserted within the connector. Adjacent such vertical surfaces are horizontal surfaces 40 shown in FIGS. 1 and 3, and extending upwardly from surfaces 40 are posts 42 integrally formed of the housing material. Extending downwardly in alignment with posts 42 are fasteners 44 that are also integrally formed with housing 12. The fasteners 44 include interior slots 46 that allow the fasteners to be deflected upon insertion of the fasteners within holes in the board 88, such holes being denominated 92 in FIGS. 3 and 4. As can be seen in FIGS. 1, 2, and 3, the upper ends of posts 42 include a groove containing a lock washer 48 that serves to limit relative upward displacement of housing 14 relative to housing 12. Interiorly of the housings is a compression spring 50, shown in FIGS. 1-3, that serves to drive the housings relatively apart as limited by the washer 48. This spring action holds the connector 10 open and ready to receive the insertion of a component board. FIG. 1 shows connector 10 open, and FIG. 2 shows the connector closed. FIG. 3 also shows the connector 10 in an open condition, and FIG. 4 shows it in a closed condition with a board inserted into the connector.

Referring now to FIG. 5, the component 60 is shown to include a projection 52 attached thereto as by rivets 54 and projecting out from side surface of the component to overlie the component board 74, note FIG. 6. The end of 52 is rounded as at 66 and interiorly, on an interior surface of 52, is a cam surface 68 that extends along the length of the projection for purposes to be described. Guide pins 72, rounded as at 73, extend below the board 74 and to either side thereof so as to protect the circuits 76 on board 74 from damage. In FIG. 5, a protective cap 90, molded of plastic, includes apertures 94 that receive guide pins 72 and a slot 92 that receives the board 74, the cap 90 being used when component 60 is uninstalled.

Figure 7:
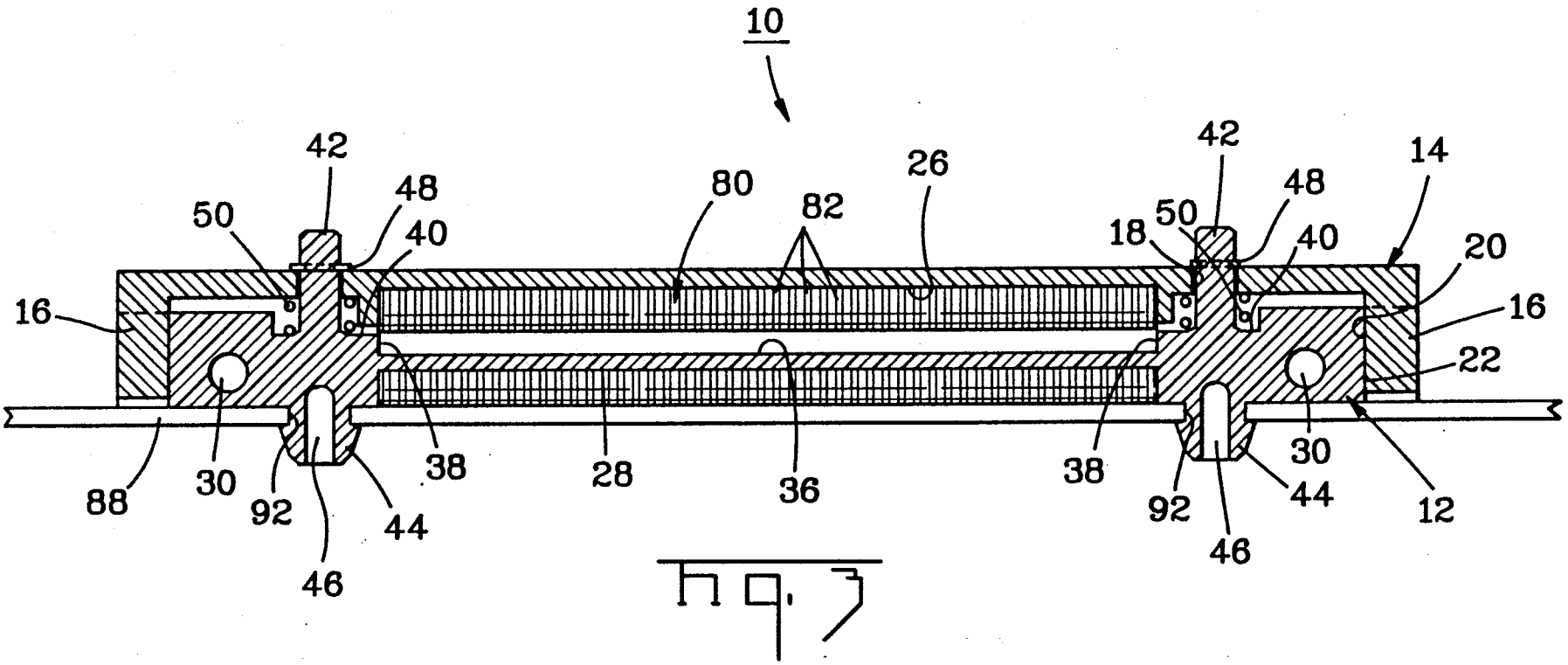
FIG. 7 is a view, like that of FIG. 6, with the component circuit board partially inserted in the connector.
Figure 8:
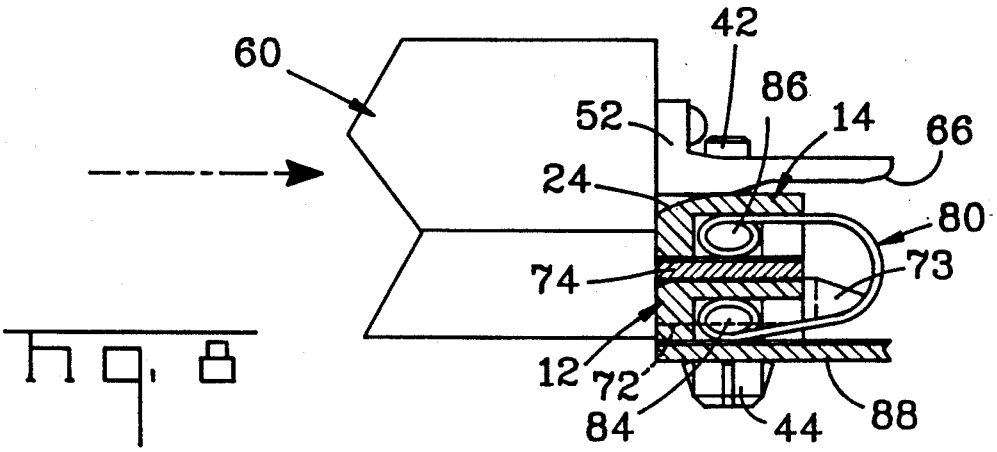
FIG. 8 is a view like that of FIG. 7 with the circuit board fully inserted and with the connector in a closed condition.

Referring now to FIGS. 6-8, the connector of the invention may be seen to include within the housings and carried thereby a flexible film circuit 80 having traces, as shown in FIGS. 1 and 2, on one side thereof, such traces shown as 82 in FIGS. 1 and 2. The film is generally U-shaped to include at each end a wrap-around portion with an elastomeric core 84 shown in the lower end portion and a core 86 shown in the upper end portion. Reference may be had to the teachings of the aforementioned Patents for connectors like that of 80; the cores 84 and 86 typically being of a resilient plastic insulating material such as urethane and the ends of the circuit being bonded thereto. As can be seen in FIGS. 6–8, the lower portion of the circuit 80 is held compressed by the lower housing, surface 28, under the force by fastener 44 extending beneath board 88 to lock housing 12 to the board and thus lock the surface 28 in the position shown in FIG. 6, compressing the film circuit. The invention contemplates an alternative circuit wherein the circuit 80 may be joined to the circuit traces 90 as by solder or other means, the upper end of the circuit associated with core 86 being utilized as to be described. As shown in FIGS. 6 and 7, the upper end is normally uncompressed and in an upward position to allow insertion of the component, board 74 carrying traces 76 into the connector in an essentially zero force insertion. FIG. 6 shows the component 60 preparatory to insertion, and FIG. 7 shows the component partially inserted. FIG. 8 shows the component fully inserted with the camming surface 68 engaging surface 24 of the upper housing and driving the upper housing downwardly from the position in FIG. 7 to the position shown in FIG. 8; the housings moving from position shown in FIG. 1 to the position shown in FIG. 2, or alternatively, from the position shown in FIG. 3 to the position shown in FIG. 4. The flexible circuit 80, the conductive traces 82 thereon, are caused to interconnect the traces 76 to the traces 90 upon the engagement shown. By displacing the component 60 to the left and withdrawing the component board from the connector, the connector will be restored to the condition shown in FIGS. 6 and 7, springs 50 driving housing 14 upwardly relative to housing 12. In this manner, a large number of electrical interconnections, on close centers, can be achieved with a minimum force of engagement and with an optimum guiding and alignment of surfaces that cooperate between the component and the connector.

We claim:

1. An electrical connector for mechanically and electrically interconnecting and disconnecting a first component to a second component, the components being in a parallel relationship and having circuits containing closely spaced conductive traces required to be interconnected to provide component functions, the connector having first and second plastic housings and means including internesting surfaces allowing relative displacement of such housings together and apart to a limited extent along a given axis with further surfaces limiting movement to hold said housings against displacement transverse to said given axis, a spring positioned on said housings to bias said housings apart but compressible to allow said housings to be driven relatively together, a flexible film containing conductive traces extending therealong to be connected at one end to the traces of the first component and to be connected at the other end to the second component upon operation of the connector, a guide on the second component operable to engage guide surfaces on the first housing and guide the circuit of the second component between the first and second housings to align the traces of the components and the circuit, a cam on the second component operable to engage cam surfaces on the second housing to drive said second housing toward said first housing to force the circuit traces of the film to interconnect the traces of at least the second component.

2. The connector according to claim 1 wherein the guide means includes tapered pins projecting from the second component and apertures in the first housing.

3. The connector according to claim 1 wherein the second component includes a projection having a cam surface extending along the side of said component and the second housing includes a cam surface extending along an edge thereof in a position to be engaged by the cam surface to effect the operation of the connector.

4. The connector according to claim 3 wherein the said projection and guide pins extend to overlie the top and side portions of the circuit of the second component to provide protection therefor.

5. The connector according to claim 1 wherein the said film includes an elastomeric core at one end compressed transverse to its length by the movement of the second housing relative to the first housing to effect an interconnection of the conductor traces thereof with the circuit traces of the second component.

6. The connector according to claim 1 wherein the said film includes an elastomeric core positioned at each end operable to be compressed to drive traces of the film circuit against the circuit traces of the circuits of the first and second components.

7. The connector according to claim 1 wherein the circuits of the first and second components are rigid boards with traces on one surface thereof and the film traces are held positioned so that the traces thereof engage the traces of the board in movement transverse to the surface thereof.

8. The connector according to claim 1 wherein the said first housing includes integral fasteners projected from each end operable to be snapped into the holes of the board of the first component to mount the connector to such board.

9. The connector according to claim 1 wherein the first housing is mounted on the board of the first component and the second housing is mounted on the first housing with the board of the second component inserted therebetween to engage the film traces of the connector.

* * * * *